US007802747B2

(12) United States Patent
Bourke et al.

(10) Patent No.: US 7,802,747 B2
(45) Date of Patent: Sep. 28, 2010

(54) LINE LENGTH ADJUSTMENT DEVICE FOR MOORING LINES AND THE LIKE

(76) Inventors: Dorothy Bourke, 732 Casemer, Lake Orion, MI (US) 48360; Timothy Bourke, 732 Casemer, Lake Orion, MI (US) 48360

( * ) Notice: Subject to any disclaimer, the term of this patent is extended or adjusted under 35 U.S.C. 154(b) by 159 days.

(21) Appl. No.: 12/051,272

(22) Filed: Mar. 19, 2008

(65) Prior Publication Data

US 2009/0236460 A1 Sep. 24, 2009

(51) Int. Cl.
*B65H 23/02* (2006.01)

(52) U.S. Cl. ..... 242/396.5

(58) Field of Classification Search ..... 242/396.1, 242/396.2, 381, 422.4, 381.3, 382, 396.5, 242/397, 397.2, 405, 405.3, 396.6, 384.7, 242/388.1, 388.2, 579, 587, 587.2, 422, 396, 242/588, 586, 392, 381.1, 395; 114/218, 114/230.1, 230.23

See application file for complete search history.

(56) References Cited

U.S. PATENT DOCUMENTS 3,851,613 A 12/1974 Armour
4,697,537 A 10/1987 Smith
4,846,090 A 7/1989 Palquist
4,878,452 A 11/1989 Regan et al.
4,977,846 A 12/1990 Landa et al.
5,365,872 A 11/1994 Obrinski
5,398,634 A 3/1995 Eagan
5,586,514 A 12/1996 Yuscavage
5,634,421 A 6/1997 Velarde
6,095,075 A 8/2000 Gordon et al.
6,431,486 B1 * 8/2002 Lee ..... 242/381.3
6,928,945 B1 8/2005 Tebo, Jr.
7,096,813 B1 8/2006 Luck
7,168,385 B1 1/2007 Thomas
2003/0168545 A1 * 9/2003 Yu ..... 242/388.1
2005/0081772 A1 * 4/2005 Alan ..... 114/218

FOREIGN PATENT DOCUMENTS

GB 2448696 A * 10/2008

* cited by examiner

*Primary Examiner*—John Q Nguyen
*Assistant Examiner*—William E Dondero
(74) *Attorney, Agent, or Firm*—John R. Benefiel

(57) ABSTRACT

A line length adjustment device includes a strap having a rope loop attached to one end, the other end wound up on a winder core in a housing which has a rope loop at an end opposite a slot receiving the strap. A gripper element normally engages the strap to lock it in any adjusted length, which is manually releasable to allow unwinding of the strap.

7 Claims, 3 Drawing Sheets

LINE LENGTH ADJUSTMENT DEVICE FOR MOORING LINES AND THE LIKE

BACKGROUND OF THE INVENTION

This invention concerns winding devices for adjusting the effective length of flexible tethers or supports such as mooring lines used to secure boats to docks or pilings, clothes lines, tent guy lines, etc.

Traditionally, the length of such lines has been adjusted with the use of knots. This necessitates the need for tying the knots properly in order to insure that unintended loosening will not occur, and is relatively time consuming. In addition, the excess length of the lines is left exposed and creates a tripping hazard in the case of mooring lines left on a dock, or requires time consuming coiling up of the excess length of the lines.

While various adjustment devices have been devised in the past, most of these are bulky, complex and inconvenient to use. Such adjustment devices when applied to boating use must have sufficient strength to secure the boat in heavy weather. In addition, boaters generally prefer an attractive traditionally nautical look of any equipment which will provide a "ship shape" storage of lines without requiring an inordinate amount of effort. Prior adjustment devices did not adequately provide such qualities It is an object of the present invention to provide a line length adjustment device which is compact, reliable and convenient to use, and which has an attractive appearance and enables neat stowage of excess line.

SUMMARY OF THE INVENTION

The above recited object of the invention is as well as other objects which will be understood upon a reading of the following claims are achieved by a winding device including a compact housing attachable to a fixed anchoring with a rope loop having ends fixed to one end of the housing.

A wind up core is rotated within a storage chamber defined within the housing by a finger engagable rotator disc attached to the windup core and recessed into the outside of the housing to present a trim appearance. A strap is inserted into a slot at another end of the housing and received in entrance slot in the wind up core to be wound thereon upon rotation of the windup rotator disc by the user.

A gripper element is loosely disposed in a convergent cavity in the housing adjacent to the entrance slot and opposite a fixed surface over which the strap passes in extending to the wind up core.

The gripper element has a release feature protruding out through a hole in the case. A main body of the gripper element has a toothed edge normally positioned to engage the strip passing over the fixed surface Any attempted pull out or unwinding of the strap causes movement of the gripper element further into the convergent cavity, creating a wedging action strongly resisting pull out of the strap. A deflectable wing feature extends from the main body disposed engaging a fixed shoulder formed in the housing interior. The deflectable wing positions the locking element toothed edge so as to engage the strap.

The gripper element feature can be moved by pushing on the release feature so as to deflect the wing feature in a direction to advance the gripper element in a direction away from the convergency of the cavity so as to allow disengagement of the toothed edge from the strap and allow the strap to be pulled past the toothed edge and unwound from the core. This allows the wind up strap to be pulled out of the housing.

The strap outer end is preferably attached to a rope loop to give an overall nautical look to the device.

DESCRIPTION OF THE DRAWING FIGURES

DETAILED DESCRIPTION

Figure 1:
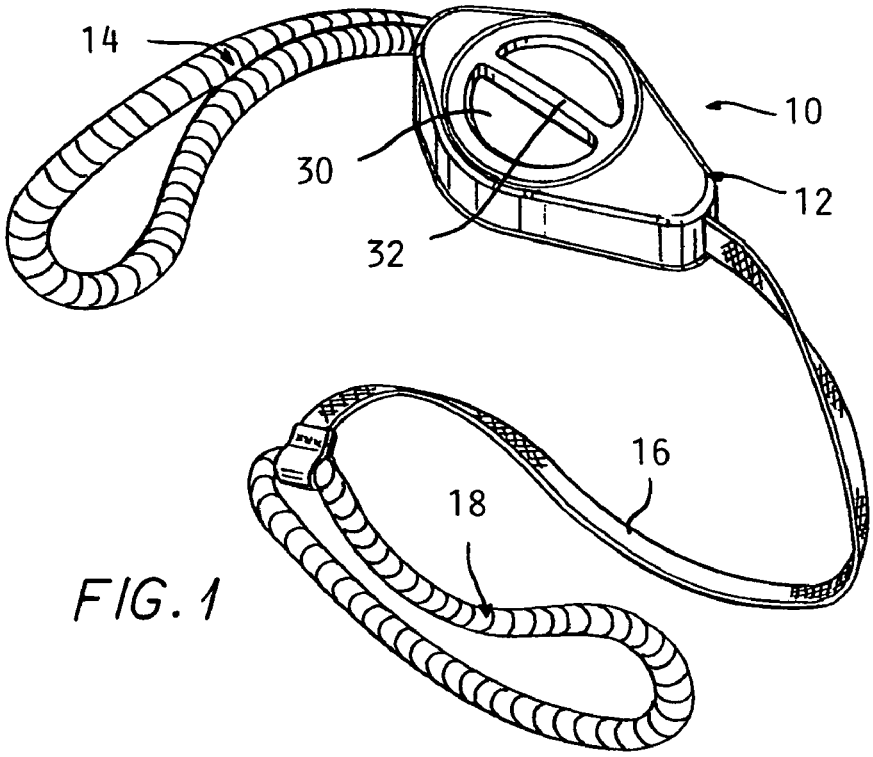
FIG. 1 is a pictorial view of the line length adjustment device according to the present invention.
Figure 3:
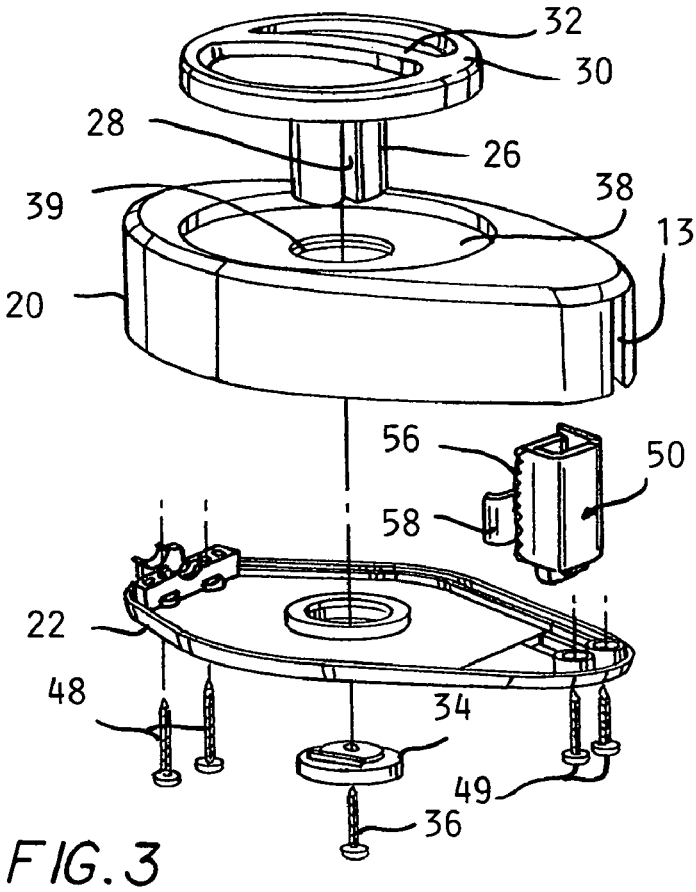
FIG. 3 is an exploded pictorial view of a housing and wind up components included in the device shown in FIGS. 1 and 2.
Figure 2:
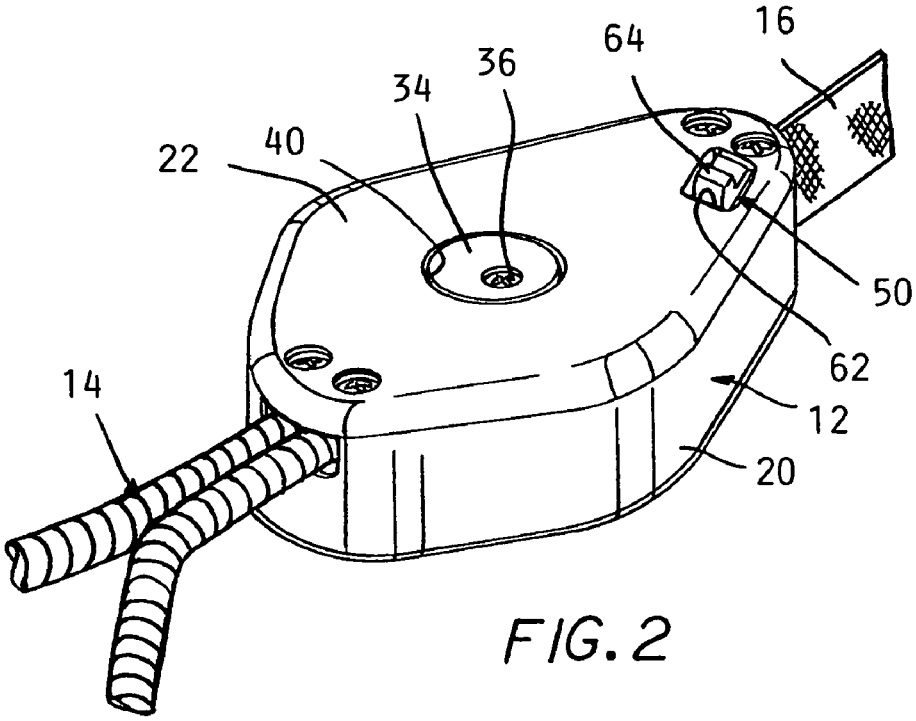
FIG. 2 is fragmentary enlarged pictorial view of the opposite side of the adjustment device shown in FIG. 1.
Figure 4:
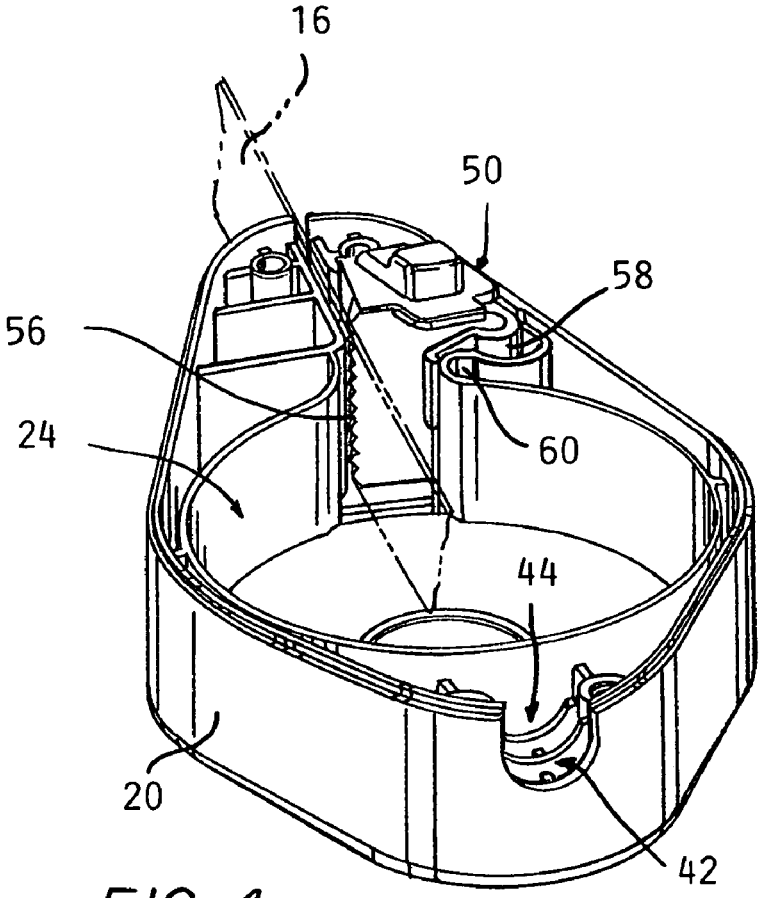
FIG. 4 is an enlarged view of the housing with the top removed depicting internal features a length of strap in phantom lines.
Figures 5, 5A:
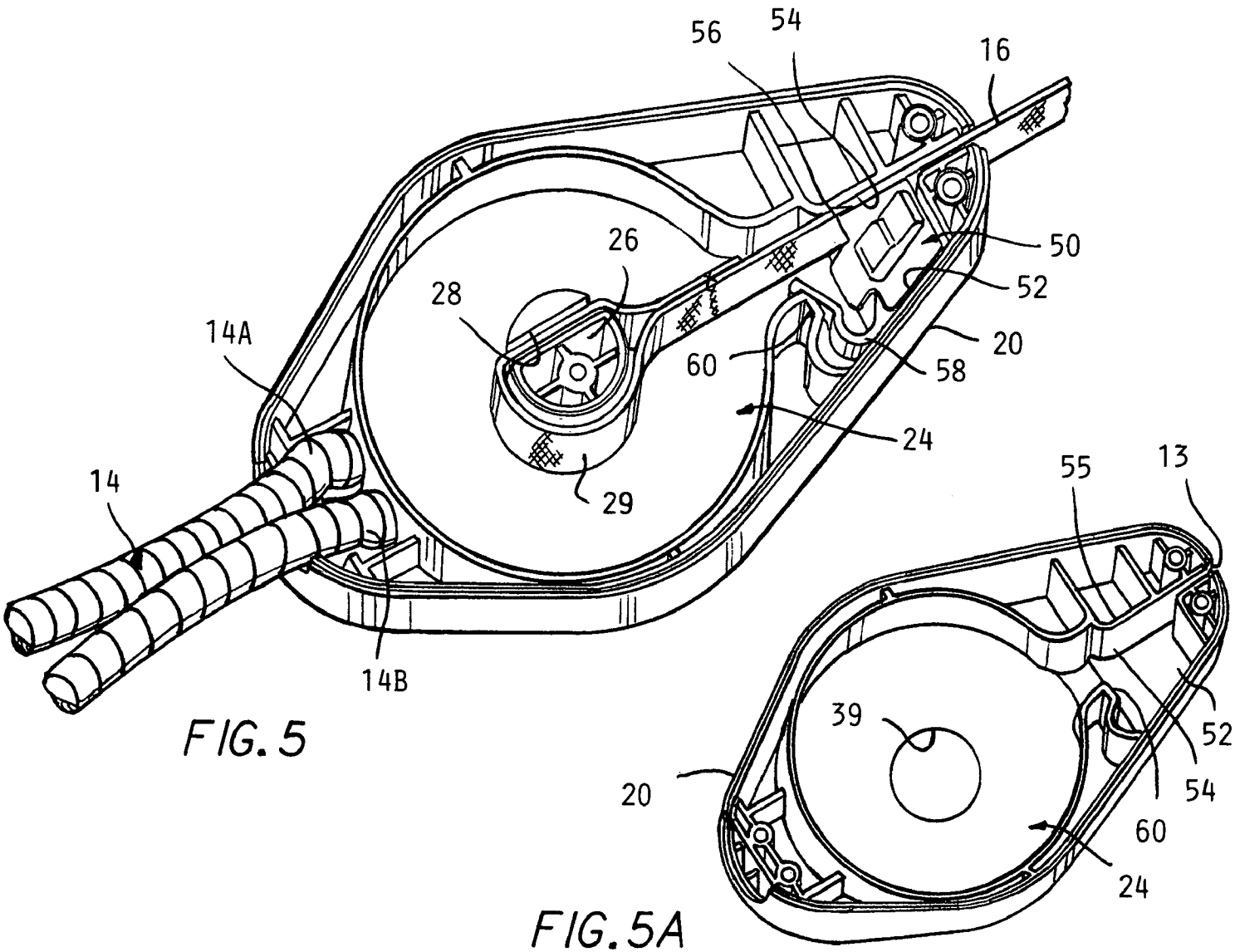
FIG. 5 is a pictorial further enlarged size view of the housing with the top removed showing a portion of the strap and rope endings.
FIG. 5A is a reduced size view of the housing with the top, a winding core and a gripper element removed to more clearly show the inner details of the housing.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, the device 10 according to the invention includes a housing 12 which is generally diamond shaped with rounded corners, generally longer in a lengthwise axis passing through opposite ends than across the width to present a trim appearance. The housing 12 is advantageously made up of molded plastic components, the plastic preferably of high strength such as glass filled nylon or the like.

A first rope loop 14 has ends fixedly attached to one end of the housing 12 to define an anchoring element for securing the device to an anchoring structure such as a stanchion, dock, piling, etc.

A high strength strap 16 such as of woven nylon has one end passed into the housing 12 through a slot 18.

A second rope loop (preferably of nylon or other durable high strength fiber) is sewn to the free end of the strap 16.

The housing 12 may be of a two piece construction, with a hollow base 20 and cover 22 enclosing a storage cavity 24 within which the strap 16 can be wound up.

This is achieved by a winder core 26 having a slot 28 for receiving a sewn loop 30 of the strap 16 so that when the core 26 is rotated, the strap 16 will be wound up thereon.

The strap windings will be fit within the generally circular storage chamber 24.

A winding spool disc 30 is affixed to one end of the winder core 26 comprising a flat disc having a finger graspable raised bar feature 32 molded thereon enabling manual rotation thereof by a user.

The winder core 26 passes into chamber 24 through a hole 39 in the base 20 opposite end of the winder core 26 is secured to a retainer disc 34 with a screw 38.

The winder disc 30 is received into a recess 38 molded into the bottom of the hollow base 20 to maintain the trim appearance of the device 10.

The cover 22 is also formed with a recess 40 receiving the retainer disc 34.

The ends 18A, 18B of the rope loop 14 pass over a saddle feature 12 molded into the base 20 and the ends are bent down into cavity 44 and a clamped with a saddle feature 46 on the cover 22 when the cover 22 is assembled to the base 20 with pairs of screws 48 and 49.

The rope ends 18A, 18B are thus secured to the one end of the housing 12 by this clamping action as well as by being held with the ends bent over at 90° by the installed cover 22.

A gripper element 50 is received in a convergent cavity 52 defined in the other end of the housing 12 opposite a fixed surface 54 also defined in the housing base 20 by an integral portion 55. The strap 16 passes over the fixed surface in extending into the storage chamber 24 and onto the winder core 26.

The gripper element 50 has a tapering shape complementary to the convergent cavity 52. A straight, toothed edge 56 extends along the wider end of the gripper element 50 extending across the height of the surface 54 and the portion of the strap 16 overlying the surface 54.

The gripper element 50 is normally yieldingly held in the convergent space 52 so as to be wedged therein by a deflectable wing portion 58 which curls out and hooks over a fixed stop 60. The one end of the gripper element 50 protrudes through a slot opening 62 in the cover 22 which is larger than that end, such that a button feature 64 can be engaged with a finger of the user.

This allows the gripper element 50 to be shifted manually in a direction out of the convergent cavity 52 by deflection of the wing portion 58 so as to disengage the sharp edge 54 from the strap 16 and create a clearance to allow the wound up length of the strap 16 to be unwound and pulled out of the housing 12 to increase the free length of the strap 16.

The invention claimed is:

1. A line adjustment device comprising:

a housing;

a rope loop connected to said housing;

a strap having a loop affixed to one end thereof and an opposite end inserted into a storage chamber in said housing;

a wind up core rotatable in said chamber by a finger engageable winder drivingly engaged therewith exposed outside said housing, said oppsite end of said strap attached to said core to be manually windable thereon by rotation of said winder; and a gripper element normally engaging a portion of said strap within said housing and restraining pull out of said strap while allowing pulling in to allow said strap to be wound onto said wind up core; said gripper element movable to be able to be disengaged from said strap, said gripper element disposed in a convergent cavity defined within said housing with an edge normally in engagement with a strap portion overlying a fixed surface defined within said housing, any pull out movement of said strap tending to wedge said edge tighter against said strap portion overlying said fixed surface as said gripper element tends to be further advanced into said convergent space by any attempted said strap pull out of said strap.

2. The device according to claim 1 wherein said locking gripper element includes a deflectable wing portion engaging a locator surface positioned in a direction away from said convergent space but holding said gripper element in said convergent space with said portion engaged with said strap.

3. The device according to claim 2 wherein said gripper element has a release feature protruding out of said housing to be manually accessible so as to allow pushing of said gripper element out of said convergent space by deflecting said wing portion to thereby disengage said portion from said strap and allow pull out from said housing.

4. The device according to claim 1 wherein said winder comprises a disc attached to said wind up core and recessed into an exterior wall of said housing and having a raised finger graspable feature thereon for rotating said disc and attached winder core.

5. The device according to claim 1 wherein said edge is toothed to better hold said strap when engaged therewith.

6. The device according to claim 1 wherein said housing is generally diamond shaped with rounded corners and longer along one axis extending through two aligned corners, a slot at one end thereof and said rope loop attached at the other end.

7. The device according to claim 1 wherein said housing includes a molded plastic component defining said storage chamber and a detachable cover.

* * * * *